US008016374B2

(12) United States Patent
Kropf et al.

(10) Patent No.: US 8,016,374 B2
(45) Date of Patent: Sep. 13, 2011

(54) PULL-OUT SLIDE FOR DRAWERS AND DRAWER

(75) Inventors: Peter Kropf, Hard (AT); Klaus Schneider, Hoechst (AT); Dieter Seewald, Walzenhausen (CH); Guenter Grabher, Fussach (AT); Franz Reischl, Schwarzenberg (AT)

(73) Assignee: Grass GmbH, Hochst/Voralberg (AT)

( * ) Notice: Subject to any disclaimer, the term of this patent is extended or adjusted under 35 U.S.C. 154(b) by 545 days.

(21) Appl. No.: 11/595,160

(22) Filed: Nov. 9, 2006

(65) Prior Publication Data

US 2007/0103043 A1 May 10, 2007

(30) Foreign Application Priority Data

Nov. 10, 2005 (AT) ..... GM765/2005
Feb. 16, 2006 (AT) ..... GM114/2006

(51) Int. Cl.
*A47B 88/00* (2006.01)

(52) U.S. Cl. ..... 312/333; 312/334.44

(58) Field of Classification Search ..... 312/333, 312/332.1, 334.1, 334.4–334.8, 334.14, 334.27, 312/334.29, 334.31, 334.32, 334.44, 215–222; 384/21, 22

See application file for complete search history.

(56) References Cited

U.S. PATENT DOCUMENTS 2,698,214 A * 12/1954 Skamser ..... 312/334.5
4,182,539 A * 1/1980 Busch ..... 312/333
4,291,929 A * 9/1981 Faust ..... 312/334.4
4,441,773 A * 4/1984 Leiper ..... 312/330.1
4,603,239 A * 7/1986 Ishii ..... 200/61.61
4,679,950 A * 7/1987 Delmege et al. ..... 384/18
4,842,422 A * 6/1989 Nelson ..... 384/19
5,040,858 A * 8/1991 Kruse et al. ..... 312/221
5,709,443 A * 1/1998 Lautenschlager ..... 312/334.14
5,895,102 A * 4/1999 Fleisch ..... 312/334.6
6,749,277 B2 * 6/2004 Michaels ..... 312/334.5
6,910,749 B2 * 6/2005 Mueller ..... 312/333
6,913,334 B2 * 7/2005 Weichelt ..... 312/334.4
6,945,618 B2 * 9/2005 Kim et al. ..... 312/334.4
7,244,006 B2 * 7/2007 Schwaerzler et al. ..... 312/334.4
7,331,643 B2 * 2/2008 Huber et al. ..... 312/319.5
7,527,343 B2 * 5/2009 Oh et al. ..... 312/402
7,549,712 B2 * 6/2009 Booker et al. ..... 312/334.6
2001/0019235 A1 * 9/2001 Hammerle ..... 312/334.4
2002/0190618 A1 * 12/2002 Salice ..... 312/334.4
2003/0234603 A1 * 12/2003 Salice ..... 312/334.5
2004/0119387 A1 * 6/2004 Schwaerzler et al. ..... 312/334.4
2004/0145286 A1 * 7/2004 Kim ..... 312/334.4
2006/0261717 A1 * 11/2006 Chirumbolo ..... 312/333
2007/0103041 A1 * 5/2007 Kropf et al. ..... 312/333

(Continued)

FOREIGN PATENT DOCUMENTS

DE 19935120 2/2001

(Continued)

*Primary Examiner* — Janet M Wilkens

(74) *Attorney, Agent, or Firm* — Kilpatrick Townsend & Stockton LLP

(57) ABSTRACT

A pull-out slide for drawers can include a cabinet member, a drawer member, with a unit which defines the closed position of the slide and/or the drawer, and which acts on the slide and/or the drawer and whereby a depth adjustment of the slide and the drawer is planned for. A holding device can be present, that engages the unit intermittently whereby the holding device and/or the unit is depth adjustable on the slide and/or height and/or side adjustable. A drawer can comprise a pull-out slide described herein.

22 Claims, 7 Drawing Sheets

U.S. PATENT DOCUMENTS

| | | | | |
|---|---|---|---|---|
| 2008/0036345 | A1* | 2/2008 | Kropf et al. | 312/333 |
| 2009/0079312 | A1* | 3/2009 | Laible | 312/334.27 |
| 2009/0096337 | A1* | 4/2009 | Langguth et al. | 312/319.8 |

FOREIGN PATENT DOCUMENTS

| | | | | |
|---|---|---|---|---|
| DE | 202005006724 | U1 | | 1/2005 |
| DE | 202005002433 | U1 | | 6/2005 |
| DE | 202005019738 | U1 | | 6/2006 |
| EP | 0502824 | B1 | | 9/1992 |
| EP | 0743032 | | | 11/1996 |
| EP | 1235271 | | | 8/2002 |
| EP | 1314842 | | | 5/2003 |
| WO | 2004/100718 | | * | 11/2004 |
| WO | WO2004/101919 | | | 11/2004 |

* cited by examiner

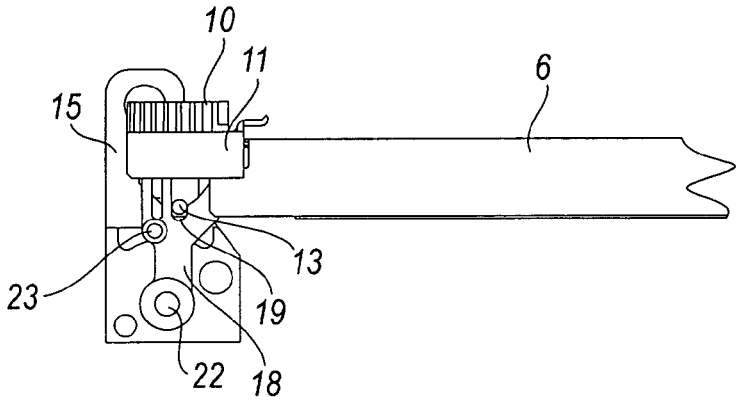
Fig. 6
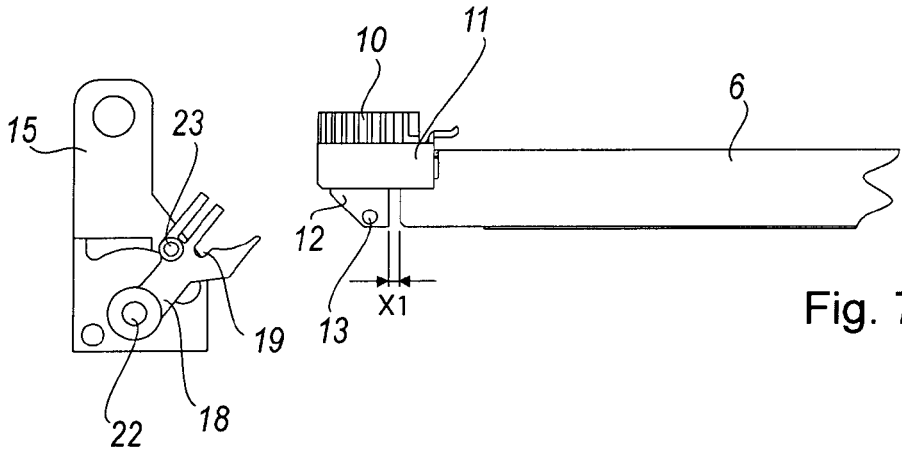
Fig. 7
Fig. 8
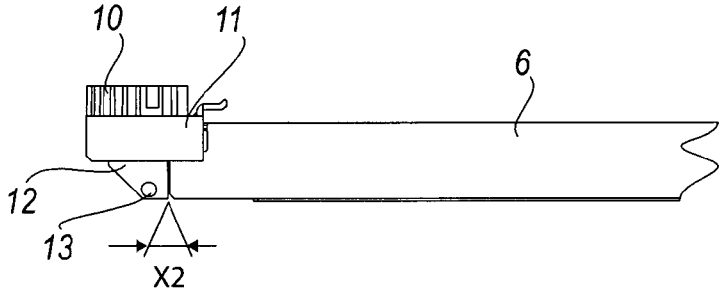
Fig. 9
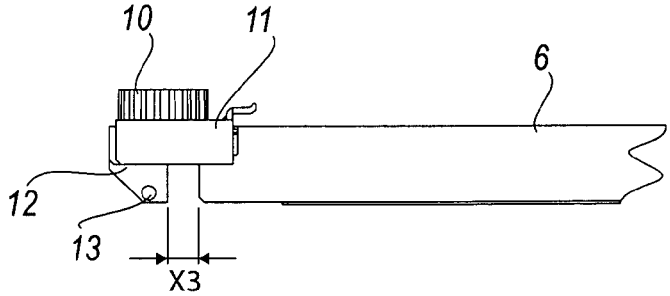

PULL-OUT SLIDE FOR DRAWERS AND DRAWER

FIELD OF THE INVENTION

The invention concerns a pull-out slide for drawers with a cabinet member, a drawer member and in some cases a center member, the pull-out slide is kept closed by a unit and a depth adjustment for the pull-out slide is provided.

In addition, the invention concerns a device for opening and closing a moveable furniture part, especially a drawer, door, flap, or similar.

BACKGROUND OF THE INVENTION

Pull-out slides for drawers or other furniture parts are, for example, provided with Touch-Latch Systems. These systems are designed to open and/or close drawers, doors, flaps or other moveable furniture parts that do not have a handle because of visual considerations. Touch-Latch Systems with finger push and locking unit are known, where the drawer is pushed inwardly in a certain distance, which causes the locking unit to open and let the drawer run out via an energy storing mechanism of the touch-latch.

It is also known that drawers and their parts, e.g. the pull-out slide, are provided with a depth adjustment of the moveable furniture part. For example, the gap between the drawer front and the front edge of the cabinet should be adjustable, in order to compensate for parts and assembly tolerances.

Known devices are used for opening and/or closing drawers, doors, flaps or other moveable furniture parts which have, for example, a touch-latch fitting, with which the drawer is pushed in a certain distance inwardly and then runs out due to a energy storing mechanism.

The disadvantage of this state-of-the-art is, that these devices require a relatively large release path and specifically cannot be released and locked from any touch point on a drawer front, door, etc. . . . with the same short release paths everywhere and the same strength.

It is the object of the invention to secure the function of the unit that defines the closing position, especially to make possible a better depth adjustment device, whereby a unit that defines the closing position of the pull-out slide is available. The depth adjustment device shall be easily adjustable, i.e. useable for differently equipped drawers.

In addition, the object of the invention is to provide a device for opening and closing a moveable furniture part or the like, which makes a minimal release path possible and also opens and closes the moveable furniture part by touching any place of the furniture part with minimal opening or closing pressure, and where the opening path of the moveable furniture part is relatively large.

The solution shall be cost effective and the furniture manufacturer should be able to easily adapt it to the width of the furniture part.

SUMMARY OF THE INVENTION

The invention is based on a pull-out slide for drawers, where the pull-out slide is comprised of cabinet member, a drawer member and possibly a center member, and where a unit is present which defines the closed position of the pull-out slide and the drawer, and which directly or indirectly affects the pull-out slide, and where a depth adjustment for the pull-out slide and the drawer are marked out. A significant aspect of the invention is, that at least one holding device holds the unit intermittently, and where the holding device and/or the unit is adjustable at the depth of the pull-out slide and/or at the height and/or sideways.

According to the invention the function of the unit defining the closing position is advantageously guaranteed.

With the adjustable holding device, i.e. the unit, a functional part is offered which influences the closing position of the drawer through its adjustment in such a way that many known run-in sizes can be considered for secure reaching and letting go of the closing position. For example, the holding device, i.e. the unit may be adjusted without steps or with precision steps, especially at least alongside a spatial axis, or also alongside two or three spatial axes which stand orthogonally to each other.

The closing function may, for example, be optimally adjusted with only one part, because of the adjustable holding device, i.e. the unit. The unit itself does not have to be adjusted when adjusting the holding device. This can be an advantage if the unit has e.g. several parts, i.e. is complex and has several attachment positions. If only the holding device is adjustable, it can be an advantage if the holding device is much smaller than the unit, i.e. simpler built, for example in one piece, e.g. in form of a holding pin. As a rule, both, the holding device and unit may be adjustable.

Secure holding of the holding device in the unit is guaranteed, especially in the closing position, even though the holding device, i.e. the unit may not reach any, i.e. any exactly fitting closing position of the drawer in a cabinet after initial assembly because of assembly of manufacturing tolerances. The recommended holding device itself can almost be adjusted at will, especially on a variety of furniture, i.e. for different positioning situations of the unit, i.e. of the holding device itself in its room positioning and alignment. The holding device can be exactly brought into an ideal position, specifically in different directions, and held steadily. Certain safety features may have to be planned for this. The unit comprises especially a disengageable arresting. i.e. locking unit, which exactly defines the position of the closed drawer. This locking unit may, for example, be part of a so called Touch Latch system. The holding device may be positioned on different parts of the drawer or cabinet, i.e. on parts designed for it.

Per the invention is the holding device at times connected to the unit, i.e. in a closed or engaged position, so that the drawer is held fixed opposite to the cabinet. As a rule, the holding device will be engaged to the unit only in the closed position. Only after a definite disengaging action may the holding device be separated from the unit, through which the drawer may be moved away from the closed position.

With the holding device, various holding mechanisms may be considered with the unit, especially mechanical ones. The holding device may, for example, be arranged on the drawer, which is moved with the drawer into the opening direction after disengagement of the closed drawer. When closing the drawer, the holding device engages the unit again and stays engaged as long as the drawer is not disengaged, i.e. stays closed.

Depth adjustment of the pull-out slide means specifically the adjustment of, i.e. against opening, i.e. pull-out direction of the drawer, i.e. full-opening of the pull-out slide, i.e. one of the members of the pull-out slide.

In one of its construction forms the pull-out slide is planned with a Touch-Latch system, which has at least one touch-latch and one locking unit, which may be built separately or connected.

The Touch-Latch is, for example arranged on the front end of the pull-out slide; it works between two slides. Each drawer may only contain one Touch-Latch, or one per pull-out slide.

The locking unit is preferably arranged on the cabinet, i.e. on the fixed furniture part, where two elements are connected mostly without play, each on one cabinet side, via at least one strength transmission device. At least one element contains a locking mechanism that defines, for example, a somewhat heart-shaped curve when moved.

It also may be conceivable that the locking unit comprises only one element with locking mechanism. For example, it is sufficient for small drawers. Opening of the drawer is guaranteed by touching any one point of the drawer front.

One of the elements works here, i.e. these elements work intermittently, also in the closed position with one holding device each directly or indirectly on the back end of the drawer slide. To make adjustment of the front gap between drawer front and cabinet possible, it is beneficial if the holding device(s) is, i.e. are adjustable in longitudinal direction to the pull-out slide, so that the closed position of the drawer and front may be adjusted.

The holding device is preferably adjustable with a usually known device, like an eccentric device, a snail screw, a screw with screw axis in the adjustment direction, a thread spindle, a gear, etc. This adjustment device, and possibly several devices are formed in a way that depth adjustment and/or height adjustment and/or side adjustment is done without tools or a standard tool using the adjustment device, which is formed accordingly.

In one version, specifically if the holding device is planned on an adjustment part, the adjustment device is placed in a holder on the drawer member and/or the drawer, and moves an adjustable part via a recess that is placed laterally to the adjustment direction, e.g. it is formed like an elongated hole. It is also possible that the adjustment device is placed into the adjustment part and can be moved with it relative to the cabinet member. The holder preferably has a profile like the slide, here in U-form, and forms a slide for the length adjustment of the adjustment part.

The unit is preferably formed as a locking unit.

The unit can also function as closing mechanism, damper, touch-latch, children's safety device, alternating closing system, locking system or as a device for opening both sides of a drawer.

It is planned to provide space for the holding device on the adjustment part, so that when the adjustment part gets adjusted, the same adjustment occurs on the holding device.

The support is rigidly connected to the drawer member and/or the drawer, i.e. welded on. For another version, it could be formed in one piece with the slide.

It is beneficial if the holding device of each pull-out slide can be adjusted independently from the holding device of the other pull-out slide for correction of a slanting drawer front.

It may also be planned that only one holding device is adjustable, or that both holding devices are coupled together and are adjusted simultaneously with only one adjustment device.

It cannot be ruled out that such a depth adjustment may be used for other elements that define the closed position of the pull-out slide, i.e. of the drawer. Such elements are, for example, closing mechanisms, dampers, touch-latches, locking systems, alternating closing systems, children's safety devices, devices for opening a drawer on both sides, etc. . . . .

It is preferred to assemble the holding device to the drawer separately from the slides. The holding device may be positioned at any point on the drawer, separately from the pull-out slide. For example, it is possible to position the holding devices to a front, bottom, side or back wall part of the drawer. This makes positioning of the holding device very flexible. The holding device may also be positioned at the edges, i.e. close to neighboring parts on the drawer, e.g. on a back panel and at the same time on a side or bottom part of the drawer.

It is also an advantage to position the holding device on a back wall of the drawer, i.e. on the back area of the drawer. To place the holding device on the drawer back panel, i.e. on adjoining parts of a back area of the drawer bottom, or a drawer side wall may be helpful for assembly/manufacturing. For example, the drawer can be free of the holding device on the lowest drawer bottom area, if there is no sufficient room for assembly.

It may also be beneficial if the holding device, i.e. the locking unit is positioned farther up, especially in the back area of a drawer, i.e. of a fixed cabinet part. Also, the holding device, i.e. locking unit is very easy to install on the back panel of the drawer, i.e. on the back area of a fixed furniture part. In this case, for example, the holding device works very well together with the corresponding segments of the locking unit which is positioned in the back area of a fixed furniture part.

It is beneficial to position the holding device on the back panel, i.e. on the back part of the drawer, and it to be adjustable in the depth of the pull-out slide and/or the height and/or sideways. This way, the holding device can be fastened exactly into the desired position. This is especially advantageous when placing the holding device on a wood drawer. Especially on wood drawers tolerances may be adhered to, which make adjustment after assembly necessary. A large chain of tolerances may be present specifically if the holding device is not mounted to the slide, but to the drawer. In case of a wood drawer, the position is defined by pre-drilled positioning holes, which may noticeably vary from the ideal position. The adjustment is especially necessary in view of the correct engagement of the holding device into the unit and arrival of the locking position with each other to define the exact locking condition.

In another preferred form of the invention the height and/or side adjustment have a positioning element with an elongated hole through which the positioning element can engage. With this arrangement height and side adjustment is especially easy.

It is much preferred that the depth and/or height and/or side adjustment is done via eccentric screw, snail screw, screw, thread spindle or a gear wheel. The allows smooth height and side adjustment of the holding device in a small space.

In addition, the invention concerns a drawer with at least one pull-out slide, as described above. The unit may, for example, be positioned on a cabinet, i.e. on the back panel, i.e. on the back area of the drawer.

One pull-out slide is positioned per drawer side and each holding device is adjustable independently from each other.

In addition, two units which are fixedly connected to each other via at least one strength transfer device may be positioned on the cabinet and engage one holding device of each pull-out slide intermittently.

BRIEF DESCRIPTION OF THE DRAWINGS

The following describes the invention in more detail in various forms, some with schematics, which are, however, only meant as an example, and do not confer any limitations.

Shown is.

DETAILED DESCRIPTION

Some of the figures show the same reference mark for corresponding parts in different examples.

Figure 1:
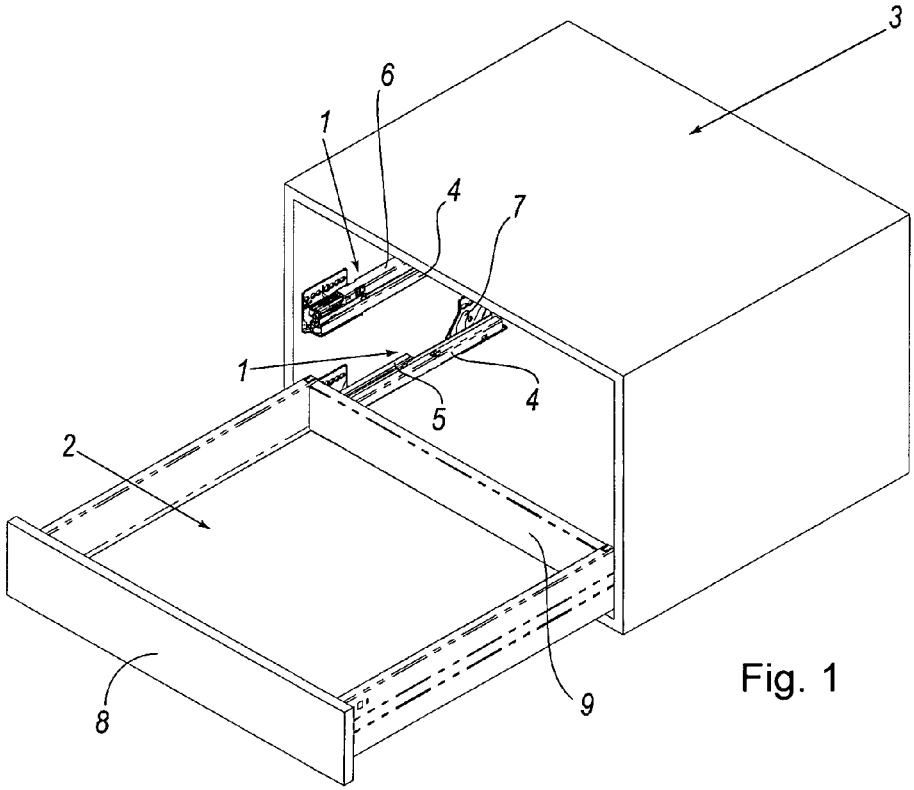
FIG. 1 a perspective view slanted from above of a cabinet with an open drawer, FIG. 2 a perspective view slanted from behind of a cabinet with a drawer, FIG. 3 a detailed view of a pull-out slide with locking unit and depth adjustment, FIG. 4 an enlarged view of a detail of the depth adjustment device on the drawer member, FIG. 5 a detail view of the locking unit, FIG. 6 a side view of the detail of the locked drawer slide, FIG. 7 a side view of a detail of the unlocked drawer slide, with the depth adjustment of the slide in the first position, FIG. 8 a side view of a drawer slide, as in FIG. 7, with the depth adjustment of the slide in the second position, FIG. 9 a side view of a drawer slide, as in FIG. 7, with the depth adjustment of the slide in the third position, FIG. 10 a perspective of a drawer slide with holding device arrangement per invention, FIG. 11 a view of the back end of the drawer slide with holding device per FIG. 10, FIG. 12 a section of the back segment of the drawer slide with holding device of FIG. 10 seen from the side, FIG. 13 perspective of another positioning situation of the holding devices on a drawer, with the drawer open, FIG. 14 positioning like FIG. 13 while the drawer is closed, FIG. 15 perspective of a detail view of a holding device positioned in back of the drawer, FIG. 16 positioning as in FIG. 15 without holding elements.

FIG. 1 shows a piece of furniture comprising a cabinet 3 and a movable drawer 2 inside of it. The drawer 2 in the lower part of the cabinet 3 is shown in the open position. A pull-out slide 1 is fastened between the cabinet 3 and the drawer 2, so the drawer 2 may be moved independently from the cabinet 3. The pull-out slide 1 comprises a cabinet member 4, fastened to the cabinet 3 by a cabinet angle 7, a center member 5 and a drawer member 6, on which the drawer 2 is positioned.

The front 8 of the drawer 2 has no handle, so that opening of the drawer 2 is achieved with the touch-latch principle. The drawer 2 is pushed inwardly by the operator, the drawer 2 is unlocked by an unlocking unit 14 (shown in FIG. 2) and driven outward by a loaded energy accumulator, i.e. touch-latch (not shown here, it could be positioned on the front end of the drawer member and abut a stop of the cabinet member).

In the upper area of the cabinet 3 is another slide 1, on which another drawer may be positioned.

Figure 2:
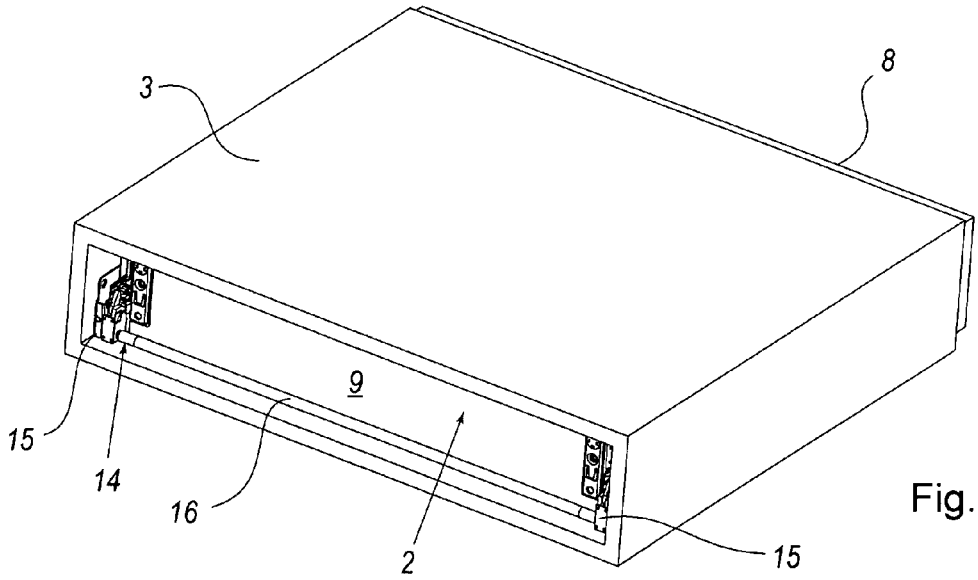

FIG. 2 shows another furniture piece, also provided with a cabinet 3 and a drawer 2, which shows a locking unit 14. This locking unit 14 defines, among others, the position of the closed drawer 2, i.e. the position of the drawer front 8 to the front edge of the cabinet 3. The distance between these two elements should be adjustable, e.g. so that the push distance that engages the opening process can be depth adjusted; or, e.g., that the position of several drawer fronts sitting on top of each other in a cabinet may be aligned.

The locking unit 14 is positioned in the back of the cabinet 3, behind the back panel 9 of the drawer 2, i.e. its back area. The back area of the drawer 2 comprises also the back thin edges of the drawer bottom and drawer sides, which are almost flush against the back panel 9. It would be possible to position the locking unit 14 directly to the cabinet 3, e.g. on the cabinet angle 7 or on the cabinet slide 4.

Figure 3:
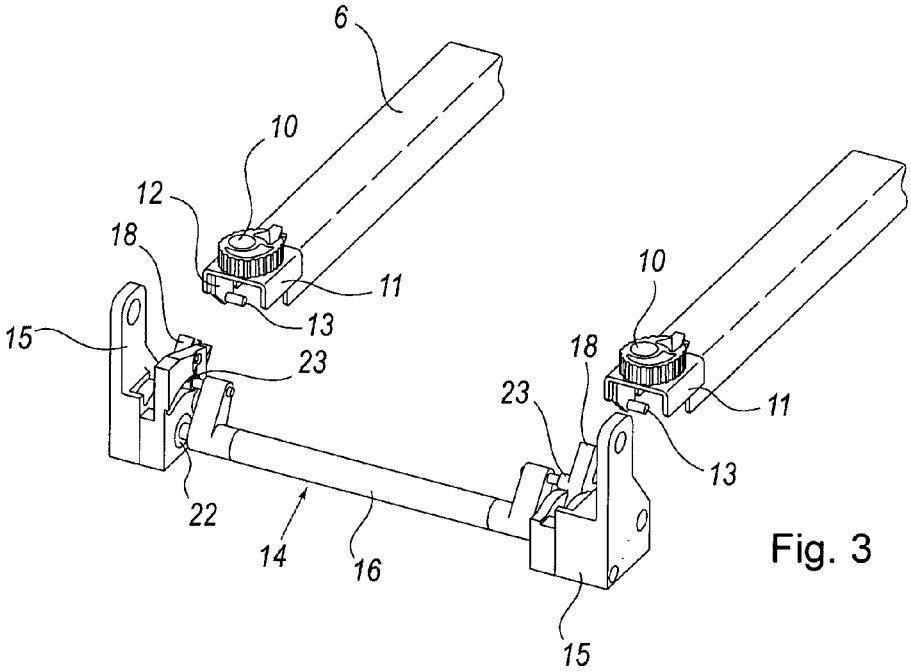

FIG. 3 shows some of the elements of FIG. 2, the locking unit 14, as well as the back part of the drawer member 6 with depth adjustment.

Figure 4:
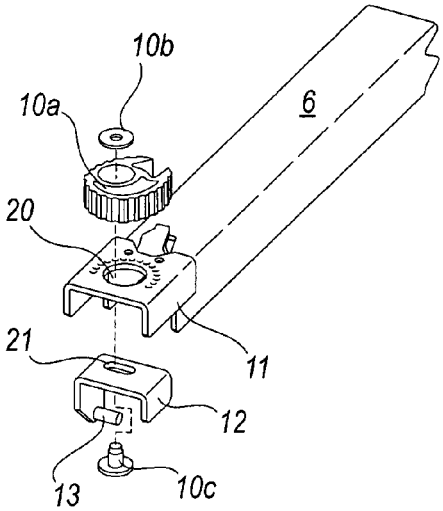
Figure 5:
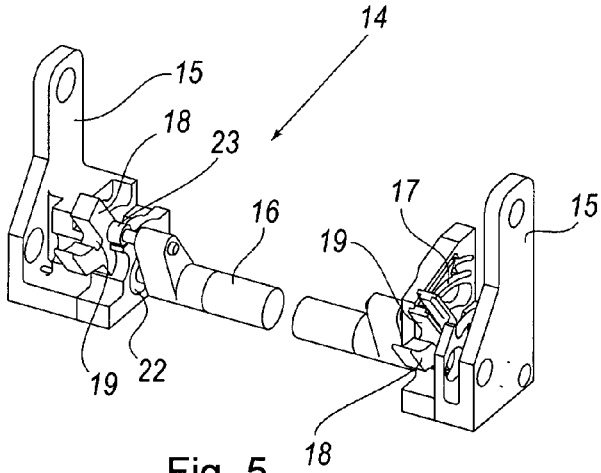

FIGS. 4 and 5 show the back end of the drawer member 6 with depth adjustment unit, i.e. locking unit 14, and with the connecting rod 16 cut in the center.

The locking unit 14 comprises two elements, which are connected without clearance by a connecting rod 16. Each element has a housing 15 that is connected to the cabinet 3. Each housing 15 contains a pivot lever 18 which intermittently engages the drawer member 6. The lever(s) 18 is/are connected by the pivot bearings 22 and 23 to the connecting rod 16.

On one side a lever 18 is being steered on a somewhat heart-shaped curve 17. This is the locking mechanism. To avoid unwanted opening problems, it is beneficial if only side of unit 14 has a locking mechanism. The other side of unit 14 acts only as a catch element with lever 18 and as a trigger, if the front 8 is touched on the opposite side of the locking mechanism.

The depth adjustment element comprises a operating element, here eccentric screw 10, which is positioned in a hole 20 of the support 11 and which via an elongated hole 21 which is placed diagonally to the adjustment direction moves the adjustment part 12, which carries a holding device, here pin 13. Pin 13 is caught by lever 18 of the locking unit 14, in this case by cutout 19 of lever 18. This causes the drawer member 6 and the drawer 2 to be held in the locked position.

Eccentric screw 10 has an adjustment wheel 10*a*, which may be turned by the operator by hand, i.e. without tools, for depth adjustment, as well as a washer 10*b* and bolt 10*c*. The bolt 10*c* moves because of the adjustment within the elongated hole 21 of the adjustment element 12. The washer 10*b* holds the bolt 10*c* with the adjustment wheel 10*a*.

The support 11 is in this case welded together with the drawer member 6 and has a U profile. It has a similar profile as the drawer member 6, or a part of the drawer member. The support 11 with this profile forms a slide for the length adjustment of adjustment part 12, which has also a U profile.

FIGS. 6 and 7 show a side view of the back part of the drawer member 6 with part of the locking unit, in this case a housing 15 with lever 18.

In FIG. 6 the closed, locked position is shown. Pin 13 is engaged by lever 18 and is rests in the recess 19 of lever 18. The locking mechanism that defines a somewhat heart-shaped curve when moved is here and in FIG. 7 not shown.

The unlocked position is shown in FIG. 7, where the drawer member 6 is shown at the beginning of the opening process or shortly before the end of the closing process. Pin 13 is free, and lever 18 swings around the pivot bearing 22.

FIGS. 7 to 9 show several depth adjustments, whereby only the back of the drawer member 6 with adjustment device is shown in FIGS. 8 and 9.

If the operating device, in this case eccentric screw 10, is turned, the gap X between the adjustment part 12 and the back edge of the drawer member 6, changes. It is possible to obtain a depth adjustment of approximately +/−3 mm from the theoretically neutral position shown in FIG. 7 with gap X1. In FIG. 8 the gap X2 is very small compared to FIG. 9 which shows a large gap, X3.

Figure 10:
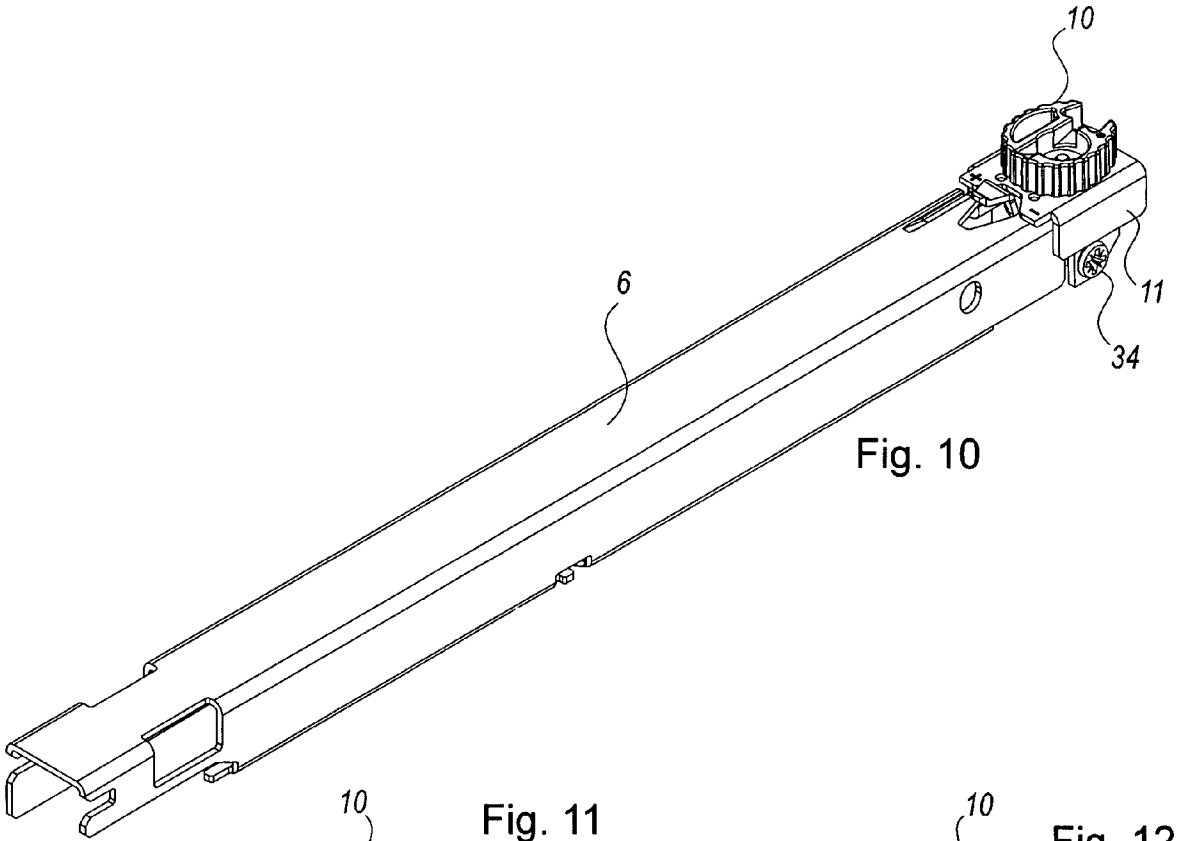

FIG. 10 shows an alternative arrangement of the holding devices on a back area of a drawer member 6. On the drawer member 6 is a support 11 with eccentric screw 10 and pin 13. With the eccentric screw 10, pin 13 may be adjusted in a downward direction on the drawer 6, i.e. in its longitudinal extension.

Figure 12:
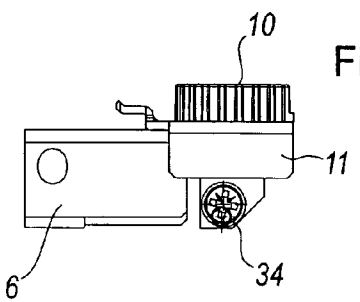
Figure 11:
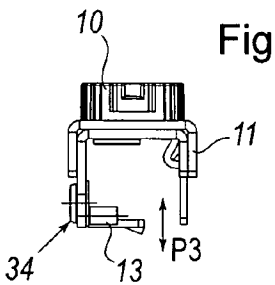

The pin 13 is also height adjustable, i.e. adjustable in the vertical direction, with an eccentric arrangement 34, as specifically shown in FIGS. 11 and 12. In principle, several other possibilities for height adjustment, especially on pin 13, are conceivable. The height adjustment for pin 13 is shown schematically in FIG. 11 by arrow P3.

Figure 13:
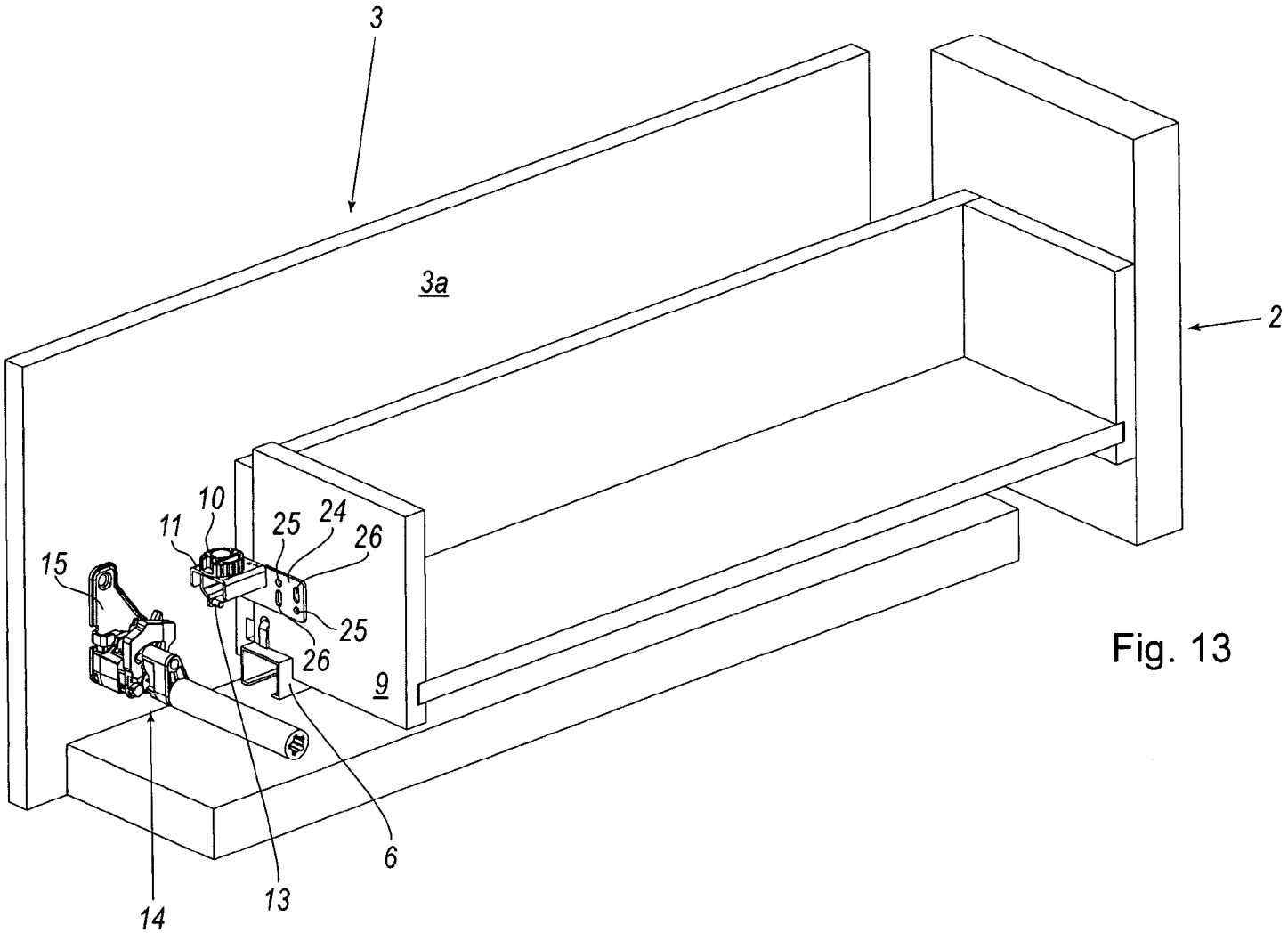

FIG. 13 shows an alternative arrangement, i.e. positioning of a holding device on a drawer 2, in this case on its back panel 9, i.e. in the back area. The drawer 2, which may be made of wood, is shown in a cabinet 3 (shown without back panel) and is received by a drawer member 6 of a pull-out slide and shown slightly open across from the cabinet. A locking unit 14 is fastened by a housing 15 to the side wall 3*a* of the cabinet 3. For better understanding, no fastening screws, etc. for mounting the housing 15 on the side wall 3*a* are shown. The locking unit 14 is essentially the same as locking unit 14 from FIGS. 3 and 5 and is only partially shown. Cabinet 3, drawer 2, i.e. locking unit 14 shown in FIG. 13 are shown in longitudinal direction of drawer 2, i.e. parallel to the side wall 3*a*.

The difference in how the holding devices are arranged in FIGS. 13 to 16 compared to FIGS. 1 to 12 is a support 11 with an adjustment part 12 and an eccentric screw 10 mounted on the back panel 9, i.e. the back area of the drawer 2. The support 11 is mounted fixedly, for example by a holding plate 24 to the back panel 9, i.e. on the back area of the drawer 2. The connection of holding plate 24 is established by connectors, e.g. screws (not shown), for which the holding plate 24 has corresponding screw holes 25 and 26 to mount it to the back panel 9, i.e. to a back area of the drawer 2. In the shown example the holding plate 24 may be fastened with two round holes 25, i.e. two elongated holes 26 to the back panel 9 with corresponding screws. Mounting can be achieved via several or all holes 25, 26 or only via single holes, e.g. one elongated hole 26 or both elongated holes 26.

The elongated holes 26 are laid out such that the holding plate 24 and at the same time the holding means, in this case a pin 13, may be positioned in a vertical direction according to arrow P1 (see FIG. 14), i.e. will be adjustable or may be fixed in different positions in the upper part of the back panel 9, i.e. in a back area of the drawer 2. Pre-drillings have been arranged for this reason on the back panel 9, i.e. in the back area of drawer 2 for fastening devices whose position may deviate from the ideal position.

If the screws for the height and side adjustment are self-stopping, one elongated hole each may be satisfactory for the height and side adjustments. Otherwise, two elongated holes each may be necessary for each directional adjustment, of which one is made for a fixing screw and one for an adjusting screw, which facilitates adjustment.

Figure 14:
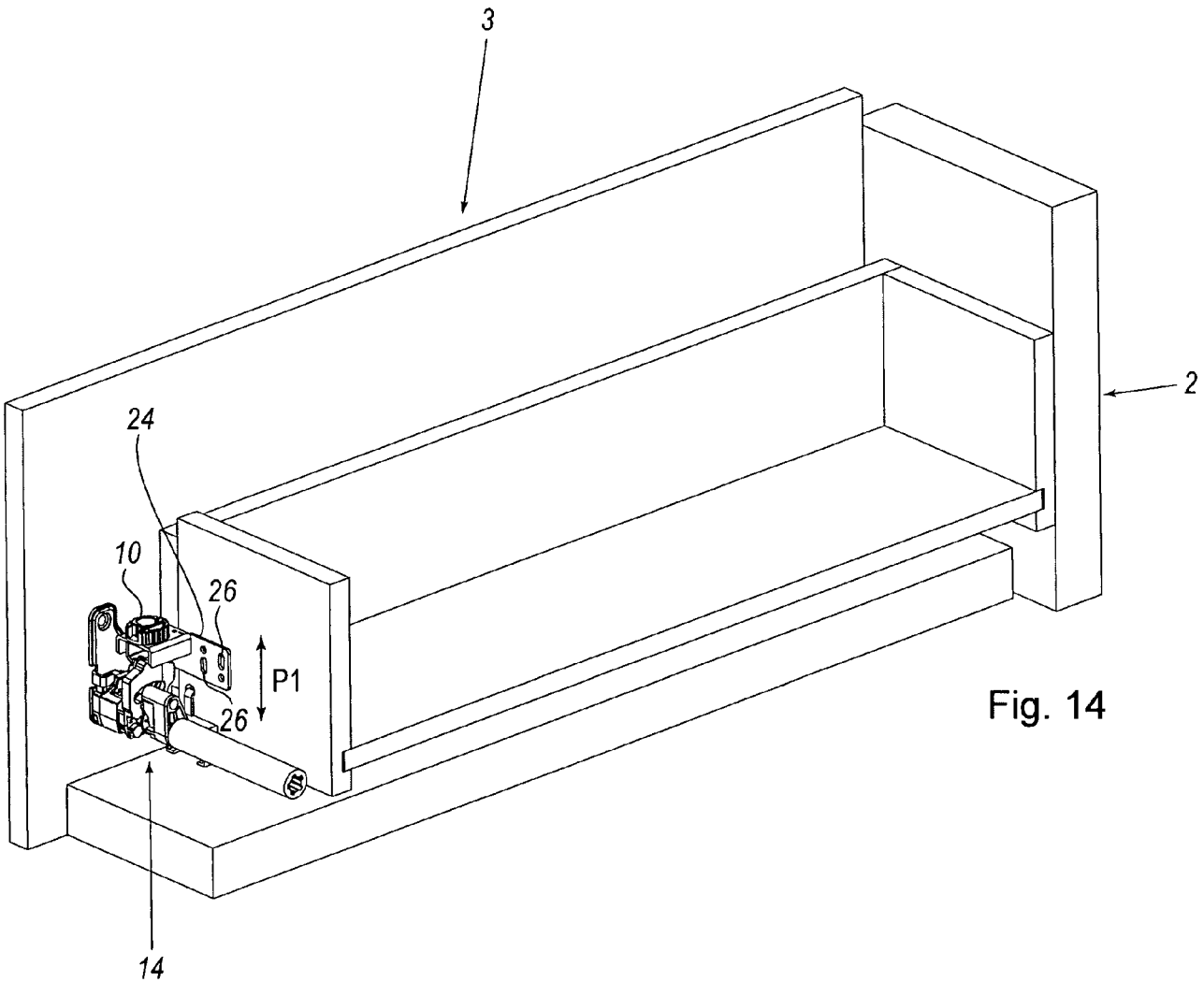

FIG. 14 shows the same arrangement as FIG. 13 with a totally closed and locked drawer 2, where the pin 13 and the locking unit 14 are in the locked position, e.g. are engaged, so a secure locking position of drawer 2 is attained in the cabinet 3. With the arrangement of FIGS. 13 and 14, pin 13 may be depth adjusted in the drawer member 6 and height adjusted according to arrow P1, via eccentric screw 10 and elongated holes 26 with fastening screws (not shown). A side adjustment, for example via other elongated holes in holding plate 24 is not planned on the arrangement example in FIGS. 13 and 14.

Figure 16:
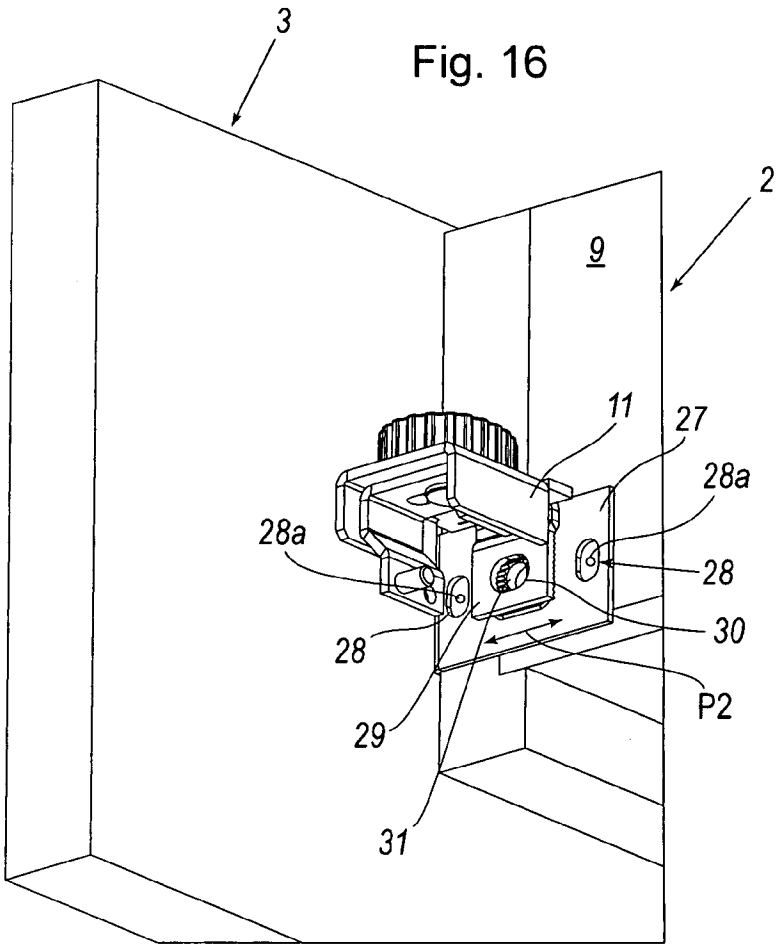
Figure 15:
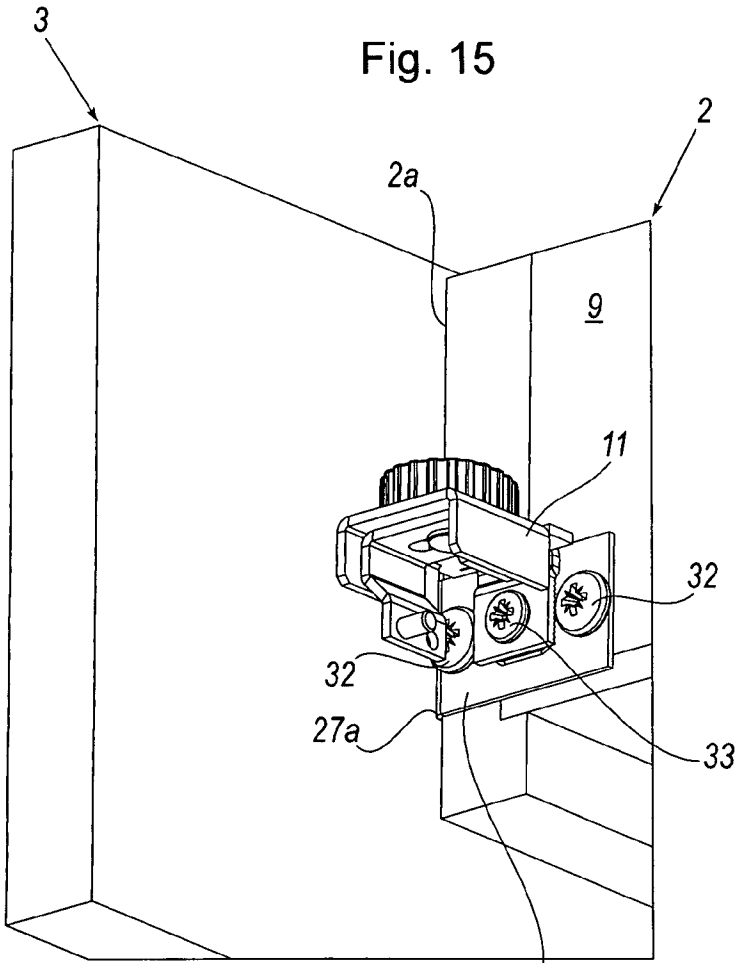

FIG. 15 and FIG. 16 show an alternative arrangement of positioning the holding devices, i.e. pin 13, support 11 with an adjustment part 12 and an eccentric screw 10 in the area of a back panel 9, i.e. the back part of the drawer 2, which is inside a cabinet 3. A locking unit is not shown on the cabinet section 3 in the schematic.

The arrangement of FIGS. 15 and 16 comprises also a holding plate 27, which may be fastened to the drawer, on which the removable support 11 may be fastened vertically offset. The holding plate 27 can be mounted offset with two elongated holes 28 into various fastening positions in the vertical direction, i.e. the upper part of the drawer 2. The back panel 9, i.e. the back area of the drawer 2 is pre-drilled accordingly. In addition, support 11 has a fastening lip 29, bent downward at an approximate right angle, which has an elongated hole 30. The elongated hole 30 is horizontal, i.e. in the engaged position it sits transverse to elongated holes 28. Via elongated hole 30, the support 11 may be adjustably fastened to holding plate 27 in a side direction according to arrow P2 (see FIG. 16), i.e. transverse to the depth of the drawer 2 and transverse to the vertical. A hole 31 is provided for this in the center of the holding plate 27.

FIG. 15 shows the positioning with positioning screws 32 for height adjustment, which engage through the elongated holes 28 and connect the holding plate 27 with the back panel 9, i.e. a back area of the drawer 2. In addition, a screw 33 is shown, which defines positioning of the fastening lip 29, which is vertically offset on the holding plate 27 according to arrow P2 of FIG. 16. Screws 32 and 33 are not shown in FIG. 16 for better representation of elongated holes 28 and 29. Usually, screw 33 will engage with some of the threads of hole 31 when placing the fastening lip 29 on the holding plate 27, but no farther than the back panel 9, i.e. the back area of the drawer 2. With the turning motion of the screw 33 the support 11 can be moved back and forth in one motion.

The opposite arrangement for the elongated holes may also be planned, where the holding plate is formed sideways for adjustment and the lip is used for height adjustment.

For better, i.e. parallel glide during height adjustment along edge 2*a* of the back panel 9, i.e. the back area of the small drawer side part of the drawer 2, an angled edge section 27*a* of the holding plate 27 grips the edge 2*a*.

REFERENCE LIST

| | |
|---|---|
| 1 | Pull-out slide |
| 2 | Drawer |
| 2a | Edge |
| 3 | Cabinet |
| 3a | Side panel |
| 4 | Cabinet member |
| 5 | Center slide |
| 6 | Drawer member |
| 7 | Cabinet angle |
| 8 | Drawer front |
| 9 | Back panel |
| 10 | Adjustment device, eccentric screw |
| 10a | Adjustment wheel |
| 10b | Washer |
| 10c | Bolt |
| 11 | Support |
| 12 | Adjustment part |
| 13 | Holding device, pin |
| 14 | Locking unit |
| 15 | Housing |
| 16 | Connector rod |
| 17 | Heart-shaped curve |
| 18 | Lever |
| 19 | Cutout |
| 20 | Hole |
| 21 | Elongated hole |
| 22 | Torque bearing |
| 23 | Torque bearing |
| 24 | Holding plate |
| 27a | Edge section |
| 28 | Elongated hole |
| 28a | Drilling |
| 29 | Fastening lip |
| 30 | Elongated hole |
| 31 | Hole |
| 32 | Screw |
| 33 | Screw |
| 34 | Eccentric configuration |

What is claimed is:

1. Pull-out slide for a drawer, comprising
a cabinet member;
a drawer member;
a unit comprising a lever; and
a holding device comprising a pin,
wherein the holding device is available to engage the unit to define a closing position of the pull-out slide by the pin of the holding device being engaged with the lever; and wherein the holding device is at least one of (a) depth adjusted and height adjusted by manipulation of an actuation device or (b) side adjusted by manipulation of an actuation device and the unit can be at least one of (a) depth adjusted and height adjusted or (b) side adjusted.

2. Pull-out slide according to claim 1, wherein the holding device can be adjusted either without a tool or with a tool.

3. Pull-out slide according to claim 1, wherein the actuation device is any one of an eccentric screw, a snail screw, a screw, a tread spindle, or a gear wheel.

4. Pull-out slide according to claim 1 wherein the holding device is fastened to the drawer member.

5. Pull-out slide according to claim 1 wherein the holding device is fastened either directly or indirectly at a back end of the drawer member.

6. Pull-out slide according to claim 1 wherein the holding device is fastened to a drawer separately from the drawer member and the cabinet member.

7. Pull-out slide according to claim 6 wherein the holding device is fastened on a back panel of the drawer.

8. Pull-out slide according to claim 6 wherein the holding device is fastened to a rear area of the drawer and is any one or any combination of depth, height or side adjustable.

9. Pull-out slide according to claim 1 further comprising a first fastening element with an elongated hole through which a second fastening element can grip and that provides either or both of height and side adjustment.

10. Pull-out slide according to claim 1 further comprising at least one of an eccentric screw, a snail screw, a screw, a thread spindle and a gear wheel that provides any one or any combination of depth, height and side adjustment of at least one of the holding device or the unit.

11. Pull-out slide according to claim 1 wherein the holding device is provided on an adjustment part and the actuation device rests in a support provided on at least one of the drawer member and a drawer and moves in a cutout of the adjustment part.

12. Pull-out slide according to claim 11 wherein one of the support, the drawer member, the cabinet member, or a center member acts as a slide for adjustment of the adjustment part.

13. Drawer mountable to a cabinet and provided with at least one pull-out slide according to claim 1.

14. Drawer according to claim 13 wherein one pull-out slide is fastened to each of two opposing sides of the drawer and the holding device of each pull-out slide is adjustable independently from each other.

15. Drawer according to claim 13 wherein two of the units are connectable to the cabinet substantially without play, by at least one power transmission device, and each intermittently engages to the holding device of each pull-out slide.

16. Pull-out slide according to claim 1, wherein the holding device is engaged to the unit only in the closing position of the pull-out slide.

17. Pull-out slide according to claim 1, wherein the unit intermittently engages the holding device.

18. The pull-out slide of claim 1, wherein the actuation device comprises a first fastening element and a second fastening element, wherein the first fastening element is operably connected to the second fastening element such that upon manipulation of the first element, the position of either or both the holding device and the unit is at least one of depth adjusted, height adjusted, or side adjusted.

19. A pull-out slide for a drawer, comprising
a cabinet member;
a drawer member;
a lever;
a holding device; and
an actuation device comprising a screw,
wherein the lever is configured to intermittently engage the holding device;
wherein a closing position of the pull-out slide is defined upon the engaging of the lever and the holding device; and
wherein the position of at least one of the holding device or the lever can be at least one of (a) depth adjusted and height adjusted or (b) side adjusted by manipulating the screw.

20. The pull-out slide of claim 19, wherein the actuation device comprises an adjustment part and wherein the screw is positioned through an opening defined by the adjustment part.

21. Pull-out slide for a drawer, comprising:
a cabinet member;
a drawer member;
a unit; and
a holding device;
a first fastening element having an elongated hole;
a second fastening element,
wherein the holding device is available to engage the unit to define a closing position of the pull-out slide; wherein the holding device is at least one of (a) depth adjusted and height adjusted by manipulation of an actuation device, or (b) side adjusted by an actuation device and the unit can be at least one of (a) depth adjusted and height adjusted or (b) side adjusted; and wherein the second fastening element is positioned through the elongated hole of the first fastening element such that the second fastening element provides either or both of height adjustment and side adjustment.

22. A drawer mountable to a cabinet comprising,
at least one pull-out slide comprising:
a cabinet member;
a drawer member;
a unit comprising a lever; and
a holding device comprising a pin,
wherein the holding device is available to engage the unit to define a closing position of the pull-out slide by the pin of the holding device being engaged with the lever; and wherein either or both of the holding device and the unit can be at least one of (a) depth adjusted and height adjusted or (b) side adjusted by manipulation of an actuation device;
wherein one pull-out slide is fastened to each of two opposing sides of the drawer and the holding device of each pull-out slide is adjustable independently from each other.

* * * * *